US010907590B2

(12) United States Patent
Tange et al.

(10) Patent No.: US 10,907,590 B2
(45) Date of Patent: Feb. 2, 2021

(54) ENGINE INTAKE AIR DUCT

(71) Applicants: INOAC CORPORATION, Nagoya (JP); TOYOTA JIDOSHA KABUSHIKI KAISHA, Toyota (JP); KABUSHIKI KAISHA TOYOTA JIDOSHOKKI, Kariya (JP)

(72) Inventors: Katsuhiro Tange, Inazawa (JP); Haruki Kato, Nishio (JP); Kyosuke Nonoyama, Toyota (JP); Yusuke Hoshikawa, Kariya (JP)

(73) Assignees: INOAC CORPORATION, Nagoya (JP); TOYOTA JIDOSHA KABUSHIKI KAISHA, Toyota (JP); KABUSHIKI KAISHA TOYOTA JTDOSHOKKT, Kariya (JP)

( * ) Notice: Subject to any disclaimer, the term of this patent is extended or adjusted under 35 U.S.C. 154(b) by 0 days.

(21) Appl. No.: 16/233,636

(22) Filed: Dec. 27, 2018

(65) Prior Publication Data

US 2019/0203681 A1 Jul. 4, 2019

(30) Foreign Application Priority Data

Dec. 28, 2017 (JP) ..... 2017-254196

(51) Int. Cl.
*F02M 35/10* (2006.01)
*F02M 35/12* (2006.01)

(52) U.S. Cl.
CPC ..... *F02M 35/10262* (2013.01); *F02M 35/10013* (2013.01); *F02M 35/10124* (2013.01);

(Continued)

(58) Field of Classification Search
CPC ..... F02M 35/10262; F02M 35/10124; F02M 35/10295

(Continued)

(56) References Cited

U.S. PATENT DOCUMENTS 5,195,484 A * 3/1993 Knapp ..... F02M 35/10013 123/198 E
6,453,866 B1 * 9/2002 Altmann ..... F02M 35/10013 123/184.21

(Continued)

FOREIGN PATENT DOCUMENTS

DE 10053145 * 5/2002 ..... F02M 35/09
DE 10053145 A1 5/2002

(Continued)

OTHER PUBLICATIONS

Communication dated Apr. 8, 2019, from the European Patent Office in counterpart European Application No. 18248076.4.

(Continued)

*Primary Examiner* — Hung Q Nguyen
*Assistant Examiner* — Anthony Donald Taylor, Jr.
(74) *Attorney, Agent, or Firm* — Sughrue Mion, PLLC

(57) ABSTRACT

An engine intake air duct 1 has an intake portion 10 that extends along a first center line A, and a main duct portion 20 that extends along a second center line B. The main duct portion 20 has a merging portion 50, a discharge opening 21, and an extending portion 40 that extends from the merging portion 50 towards an opposite end to the discharge opening 20. A reflecting wall 41 is provided at an end face of the extending portion 40. The intake portion 10 merges with the main duct portion 20 in such a way that the first center line A is directed towards a downstream end of the main duct portion 20.

7 Claims, 11 Drawing Sheets

(52) U.S. Cl.
CPC ..... *F02M 35/10131* (2013.01); *F02M 35/10295* (2013.01); *F02M 35/1211* (2013.01); *F02M 35/1216* (2013.01); *F02M 35/1233* (2013.01); *F02M 35/1261* (2013.01); *F02M 35/1277* (2013.01); *F02M 35/10111* (2013.01)

(58) Field of Classification Search
USPC ..... 123/184.21
See application file for complete search history.

(56) References Cited

U.S. PATENT DOCUMENTS 6,804,360 B1 * 10/2004 Misawa ..... F02M 35/1227 381/71.1
7,393,372 B2 * 7/2008 Cassell ..... F02M 35/024 123/198 E
8,166,775 B2 * 5/2012 Choi ..... B60H 1/00564 181/224
2005/0051375 A1 * 3/2005 Momosaki ..... F02M 35/10013 180/219
2009/0071432 A1 * 3/2009 Carpenter ..... F02M 35/10078 123/184.57
2009/0084344 A1 * 4/2009 Fasan ..... B60K 13/02 123/198 E
2010/0083928 A1 * 4/2010 Saito ..... F02M 35/02 123/184.56
2013/0263810 A1 * 10/2013 Tucker ..... F02M 35/108 123/184.53
2014/0190439 A1 * 7/2014 Kuraoka ..... F02M 35/1255 123/184.57
2015/0322867 A1 * 11/2015 Ito ..... F02M 35/10262 123/184.21
2016/0237881 A1 * 8/2016 Ookawa ..... F02B 37/16

FOREIGN PATENT DOCUMENTS

| | | | | | |
|---|---|---|---|---|---|
| DE | 102007061179 | A1 | | 6/2008 | |
| DE | 112011100387 | | * | 12/2012 | ..... F02M 35/088 |
| EP | 1515037 | A1 | | 3/2005 | |
| JP | 58-156136 | A | | 9/1983 | |
| JP | 61-190159 | A | | 8/1986 | |
| JP | 3-122263 | U | | 12/1991 | |
| JP | 03122263 | U | * | 12/1991 | ..... F02M 35/10295 |
| JP | 7-14155 | U | | 3/1995 | |
| JP | 2004-150309 | A | | 5/2004 | |
| JP | 2004150309 | | * | 5/2004 | ..... F02M 35/10 |
| JP | 2004-231075 | A | | 8/2004 | |
| JP | 2006130989 | | * | 5/2006 | ..... B60H 1/00 |
| JP | 2009-280168 | A | | 12/2009 | |
| JP | 4551184 | B2 | | 9/2010 | |
| JP | 2013-224644 | A | | 10/2013 | |
| WO | 2007049908 | A1 | | 5/2007 | |
| WO | 2011094334 | A1 | | 8/2011 | |
| WO | 2015056479 | A1 | | 4/2015 | |

OTHER PUBLICATIONS

Communication dated Dec. 3, 2019, from the Japanese Patent Office in counterpart application No. 2017-254196.
Communication dated May 4, 2020 issued by the European Intellectual Property Office in counterpart European Application No. 18 248 076.4.
Communication dated Feb. 12, 2020, issued by the Japanese Patent Office in counterpart Japanese Application No. 2017-254196.

* cited by examiner

ENGINE INTAKE AIR DUCT

TECHNICAL FIELD

The present invention relates to an engine intake air duct.

BACKGROUND ART

JP-A-2013-224644 (Patent Document 1) describes a resonator-mounted intake air duct where a duct main body internally passing and flow air and a resonator are integrated.

Severe quietness is now required on engine intake air ducts as vehicles have become quieter in recent years. Conventionally, noise of a frequency band of 80 to 600 Hz (so-called engine noise) has been required to be reduced, and such engine noise has been attempted to be reduced by use of resonator or likes. In recent years, however, noise of a frequency band of 600 to 2000 Hz is now required to be reduced as a result of strengthening the regulation on external vehicle noise.

SUMMARY OF THE INVENTION

An object of the invention is to provide an engine intake air duct which is small in size, whose pressure loss is small and which facilitates a reduction in noise of a frequency range of 600 to 2000 Hz.

According to an aspect of the invention, there is provided an engine intake air duct configured to be connected to a vehicle air cleaner, the engine intake air duct comprising:

an intake portion having an intake opening configured to draw air and extending along a first center line; and a main duct portion having a discharge opening configured to discharge air towards the vehicle air cleaner and extending along a second center line, wherein the main duct portion includes:

a merging portion connected to the intake portion;

the discharge opening provided at one end portion of the second center line; and an extending portion provided at the other end portion of the second center line and extending from the merging portion towards an opposite end to an end where the discharge opening is provided, wherein a reflecting wall configured to reflect a sound from the vehicle air cleaner is provided at an end face of the extending portion so as to intersect the second center line, and wherein the intake portion merges with the main duct portion in such a way that the first center line is directed towards a downstream end of the main duct portion.

According to another aspect of the invention, there is provided the engine intake air duct according to the above, wherein the main duct portion has a straight portion extending from the merging portion towards the discharge opening in such a way that the second center line becomes straight, and wherein the intake portion has a curved shape at a connecting side with the main duct portion in such a way that a downstream point on the first center line is always situated farther from the reflecting wall than an upstream point in a duct direction along the second center line being straight in the straight portion.

According to another aspect of the invention, there is provided the engine intake air duct according to the above, wherein a width dimension of the extending portion which intersects an extension of the second center line being straight in the straight portion at right angles and corresponds to an extending direction of the intake portion, is greater than a width dimension of the straight portion which intersects the second center line in the straight portion at right angles and corresponds to the extending direction of the intake portion.

According to another aspect of the invention, there is provided the engine intake air duct according to the above, wherein a reinforcement portion that extends in a direction intersecting the second center line and configured to connect between facing inner walls of the main duct portion, is provided in at least one of the merging portion and the extending portion.

According to another aspect of the invention, there is provided the engine intake air duct according to the above, wherein at least part of the reinforcement portion is provided in a position passing through the second center line in the extending portion or a position passing through an extension of the second center line.

According to another aspect of the invention, there is provided the engine intake air duct according to the above, wherein a projection that projects towards an interior of the intake portion, is provided at a merging side end portion of a first side wall of the intake portion with which an inner wall of the extending portion merges.

According to another aspect of the invention, there is provided the engine intake air duct according to the above, wherein the projection is a triangular prism extending in a direction intersecting the first center line.

According to another aspect of the invention, there is provided the engine intake air duct according to the above, wherein a flow regulating fin that extends along the first center line, is provided in the intake portion.

According to another aspect of the invention, there is provided the engine intake air duct according to the above, wherein the flow regulating fin connects between inner walls of the intake portion, the inner walls facing each other in a direction intersecting the first center line.

According to one aspect of the invention, there is provided the engine intake air duct which is small in size, whose pressure loss is small and which facilitates a reduction in noise of the frequency range of 600 to 2000 Hz.

According to an aspect of the disclosure, there is provided an engine intake air duct configured to be connected to a vehicle air cleaner, the engine intake air duct comprising:

an intake portion having an intake opening configured to draw in air, the intake portion extending along a first center line of the intake portion;

a merging portion provided at the intake portion; a main duct portion having a discharge opening configured to discharge the air towards the vehicle air cleaner, the main duct portion extending along a second center line of the main duct portion, such that the main duct portion has a straight portion extending from the merging portion along the second center line; and an extending portion provided at the merging portion, the extending portion extending from the merging portion towards a location opposite to the straight portion and along a third center line of the extending portion, wherein a reflecting wall configured to reflect sound from the vehicle air cleaner is provided at an end face of the extending portion such that the reflecting wall is perpendicular to each of the second center line of the straight portion of the main duct portion and the third center line of the extending portion, wherein the intake portion merges with the main duct portion in such a way that the first center line of the intake portion is directed towards the straight portion of the main duct portion, wherein the intake portion is defined by a curved segment such that with respect to a direction of a flow of the air in the straight portion of the main duct portion, a downstream point within the curved segment and on the first center line of the intake portion is always situated farther from the reflecting wall than an upstream point within the curved segment and on the first center line of the intake portion, wherein a width dimension of an entirety of the extending portion, in an area from the reflecting wall to the merging portion is greater than a width dimension of the straight portion of the main duct portion, and wherein the third center line of the extending portion is out of alignment with the second center line of the straight portion of the main duct portion such that with respect to a direction of a flow of air through the intake opening of the intake portion, the third center line of the extending portion is located closer to the intake opening than the second center line of the straight portion of the main duct portion .

DESCRIPTION OF EMBODIMENTS

Hereinafter, referring to drawings, embodiments of an engine intake air duct according to the invention will be described. The invention is not limited to those embodiments that will be described below but is intended to include all modifications that are made within a meaning and scope defined by a scope of claims made herein and equivalent to the scope of the claims.

First Embodiment

Figure 1:
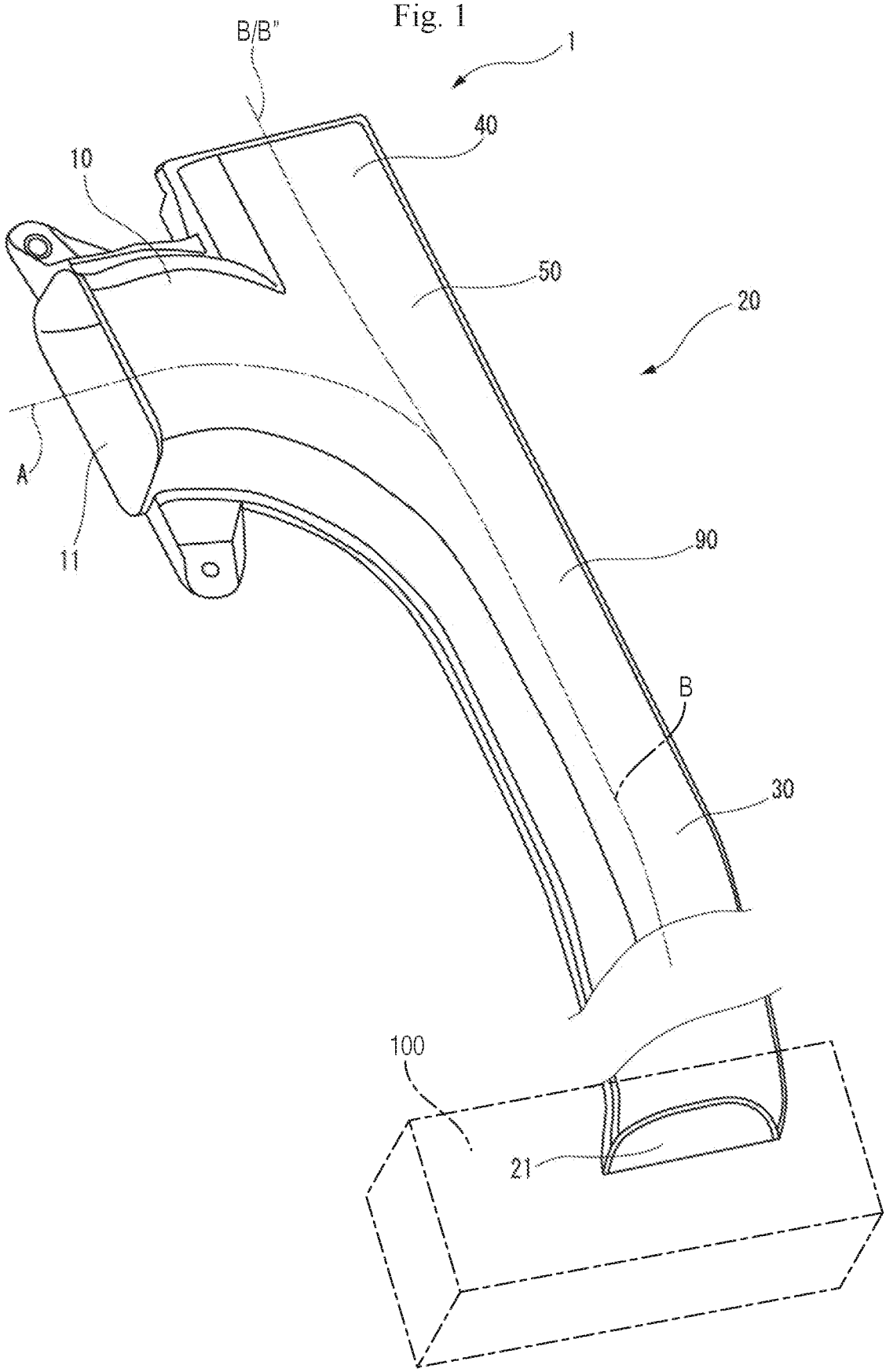
FIG. 1 is a perspective view of an engine intake air duct according to a first embodiment of the invention.

Firstly, an engine intake air duct according to a first embodiment will be described. FIG. 1 is a perspective view of an engine intake air duct 1 according to the first embodiment of the invention.

As FIG. 1 shows, the engine intake air duct 1 according to the first embodiment is a duct connected to a vehicle air cleaner (100) for supplying fresh air to an engine, which is an internal combustion engine. Outside air is drawn into the engine intake air duct 1 and is then sent into the engine by way of the vehicle air cleaner. Outside air is drawn into the engine intake air duct 1 from an intake opening 11 and is discharged from a discharge opening 21.

The engine intake air duct 1 can be formed from, for example, thermoplastic resin through an injection molding or a blow molding. The thickness of the engine intake air duct 1 can be on the order of 2.5 mm. The engine intake air duct 1 has an intake portion 10 and a main duct portion 20.

The intake portion 10 has the intake opening 11 and connects to the main duct portion 20. The intake portion 10 extends along a first center line A that is curved. The first center line A is a center line of an inner wall of the intake portion 10. The first center line A is a line that is obtained by continuously connecting center points in inner areas of the intake portion 10 that appear in sections where a sectional area of the intake portion 10 becomes the smallest, in a direction in which the intake portion 10 extends. The intake portion 10 merges into the main duct portion 20 in such a way that the first center line A is directed towards a downstream end of the main duct portion 20. Then, in this embodiment, a downstream end (a connecting end with the main duct portion 20) of the first center line A is curved towards a straight portion 90 of the main duct portion 20.

The intake portion 10 constitutes a portion from which air is drawn into the engine intake air duct 1. The intake portion 10 connects to the main duct portion 20. In the following description, an end of the curved first center line A where the intake opening 11 is provided is defined as an upstream, and the end of the curved first center line A where the intake portion 10 connects to the main duct portion 20 is defined as a downstream. The intake portion 10 may be configured so that the first center line A becomes a straight line. Additionally, although the intake portion 10 is described as having an oval (elliptic) cross-sectional shape, the intake portion 10 also may have a polygonal or circular cross-sectional shape.

The main duct portion 20 constitutes a portion where air drawn in from the intake portion 10 is discharged towards the vehicle air cleaner. In the illustrated example, although the main duct portion 20 has an angular cylindrical shape, the main duct portion 20 also may have a circular or elliptic cylindrical shape. The main duct portion 20 extends along a second center line B. The second center line B is a center line of an inner wall of the main duct portion 20. The second center line B is a line that is obtained by continuously connecting center points in inner areas of the main duct portion 20 that appear in sections where a sectional area of the main duct portion 20 becomes the smallest, in a direction in which the main duct portion 20 extends.

The main duct portion 20 has the discharge opening 21, an exhaust portion 30, an extending portion 40, a merging portion 50 and the straight portion 90. The extending portion 40, the merging portion 50 and the straight portion 90 are aligned sequentially in this order along the second center line B. The extending portion 40 extends along an extension of the second center line B in the straight portion 90. The merging portion 50 is provided between the extending portion 40 and the straight portion 90.

The exhaust portion 30 is provided at one end portion of the second center line. The discharge opening 21 is provided at one end portion of the exhaust portion 30 along the second center line. The discharge opening 21 is provided at a most downstream end portion of the engine intake air duct 1 in a direction in which air flows through the engine intake air duct 1. The exhaust portion 30 is a portion connecting the straight portion 90 and the discharge opening 21. The exhaust portion 30 may be formed into a shape which makes the second center line B into a straight line, or a shape which makes the second center line B into a curved line.

The extending portion 40 is provided at the other end portion of the second center line B of the main duct portion 20, and this extending portion 40 extends from the merging portion 50 in an opposite direction to the discharge opening 21. A reflecting wall 41 is provided at an end face of the extending portion 40 along the second center line B. The reflecting wall 41 is provided so as to intersect the second center line B. The reflecting wall 41 is configured so as to reflect sound to a side of the discharge opening 21. The reflecting wall 41 is provided so as to close an opening at the other end portion of the main duct portion 20 along the second center line B. The reflecting wall 41 reflects a sound in the engine intake air duct 1 that comes from the vehicle air cleaner and functions to reduce a sound level inside the intake air duct 1.

The merging portion 50 is provided between the straight portion 90 and the extending portion 40. The intake portion 10 connects to the merging portion 50. A portion of the main duct portion 20 that lies at the other end portion of the second center line B of the merging portion 50 is defined as the extending portion 40, and a portion of the main duct portion 20 that lies at the one end portion of the second center line B of the merging portion 50 is defined as the straight portion 90. The second center line of the extending portion 40 is defined as a third center line B".

The straight portion 90 constitutes a portion that extends from the merging portion 50 towards the discharge opening 21. The straight portion 90 is formed into a shape that makes the second center line B into a straight line. The straight portion 90 constitutes a portion where a flow of engine noise is put right which enters the engine intake air duct 1 from the vehicle air cleaner so that the engine noise moves towards the extending portion 40.

The intake air duct 1 according to this embodiment includes the reflecting wall 41 configured to reflect sound from the vehicle air cleaner. Due to this, the engine noise that enters the engine intake air duct 1 from the vehicle air cleaner by way of the discharge opening 21 to propagate within the main duct portion 20 is reflected by the reflecting wall 41 and thereafter travels again towards the discharge opening 21 within the main duct portion 20. Then, this reflected sound interacts with a sound from the air cleaner, whereby noise propagating towards the intake opening 11 is reduced.

A noise from the vehicle air cleaner, in particular, a noise of a frequency band of 800 to 1000 Hz, which is a noise that is necessary to be reduced in accordance with the regulation on vehicle external noise, can be reduced effectively by setting a length of the extending portion 40, that is, a distance from the position where the intake portion 10 connects to the main duct portion 20 to the reflecting wall 41. It is preferable that the distance is set in a range of 50 to 75 mm.

Figure 2:
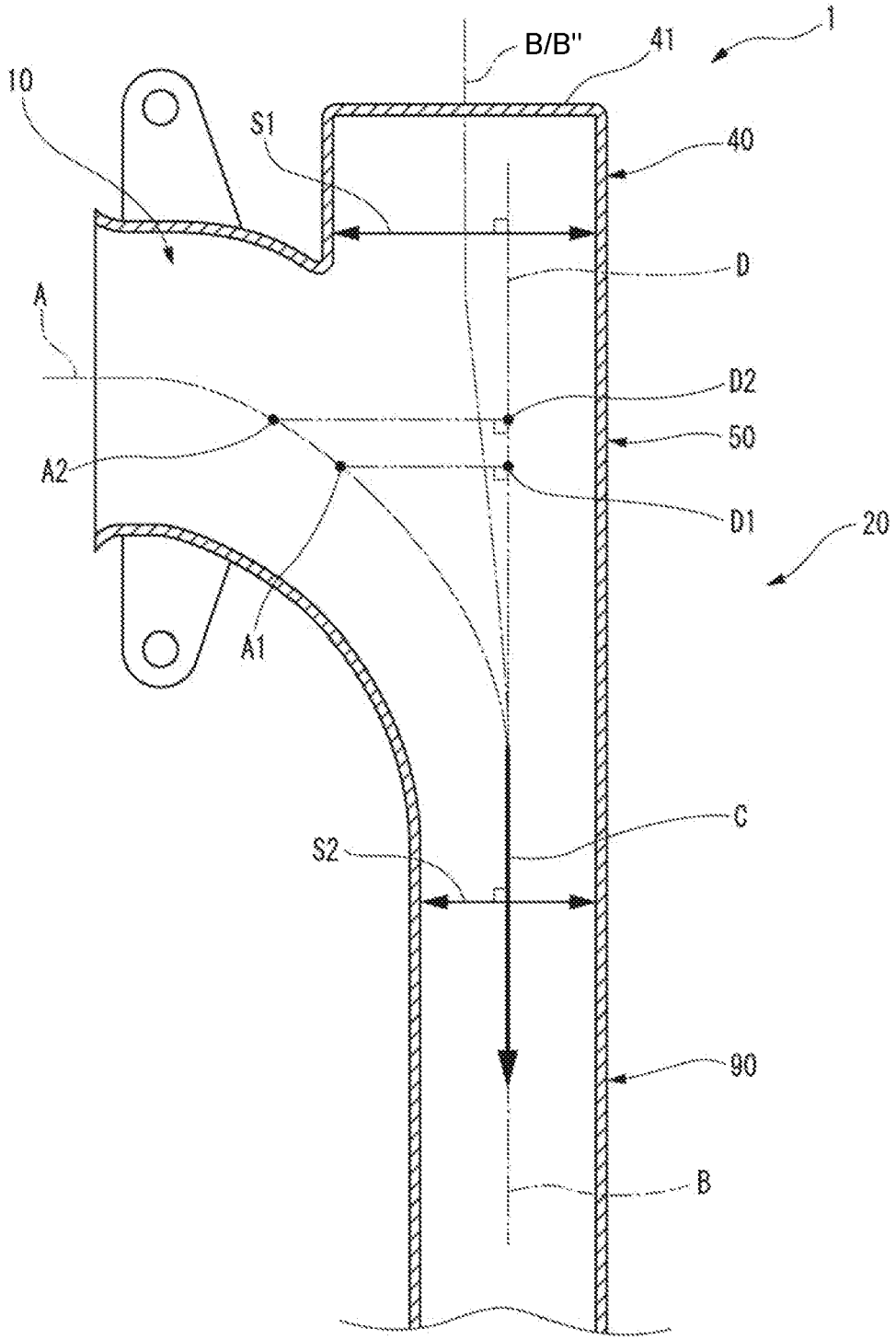
FIG. 2 is a sectional view of the engine intake air duct according to the first embodiment of the invention.

FIG. 2 is a sectional view of the engine intake air duct 1 shown in FIG. 1. As FIG. 2 shows, a direction formed by the straight second center line B in the straight portion 90 is called a duct direction C. The intake portion 10 is curved so that a downstream point on the first center line A is always situated nearer to the discharge opening 21 than an upstream point in relation to the duct direction C at a side where the intake portion 10 connects to the main duct portion 20. For example, a point on the first center line A is defined as a point A1, and a point on the first center line A that is situated further upstream than the point A1 is defined as a point A2. A point of intersection between a perpendicular drawn from the point A1 towards an imaginary line D (an extension of the straight second center line in the straight portion 90) extending in the duct direction C and the imaginary line D is referred to as a point D1. Additionally, a point of intersection between a perpendicular drawn from the point A2 towards the imaginary line D extending in the duct direction C and the imaginary line D is referred to as a point D2. Then, the point D1 is situated farther from the reflecting wall 41 than the point D2 in relation to the duct direction C. The intake portion 10 is curved in relation to the first center line A so that this relationship is always established at the side where the intake portion 10 connects to the main duct portion 20. This allows the intake portion 10 to connect to the main duct portion 20 smoothly.

Here, the inventor has studied various types of noise damping mechanisms including a Helmholtz resonator in designing engine intake air ducts.

The inventor previously proposed the intake air duct described in Japanese Patent No. 4551184 (Patent Document 2). This intake air duct was intended for use in a seat air conditioning system configured to discharge temperature-controlled air from a surface of a vehicle seat. The inventor originally thought that the intake air duct of this type was not suitable for an engine intake air duct. Thus, in studying the engine intake duct 1, the inventor studied an intake air duct having a different structure from that of the intake air duct of Patent Document 2. This is because the inventor thought in an initial stage of the study that with its great pressure loss, the intake air duct of Patent Document 2 would not be not suitable for an engine intake duct.

Figure 3:
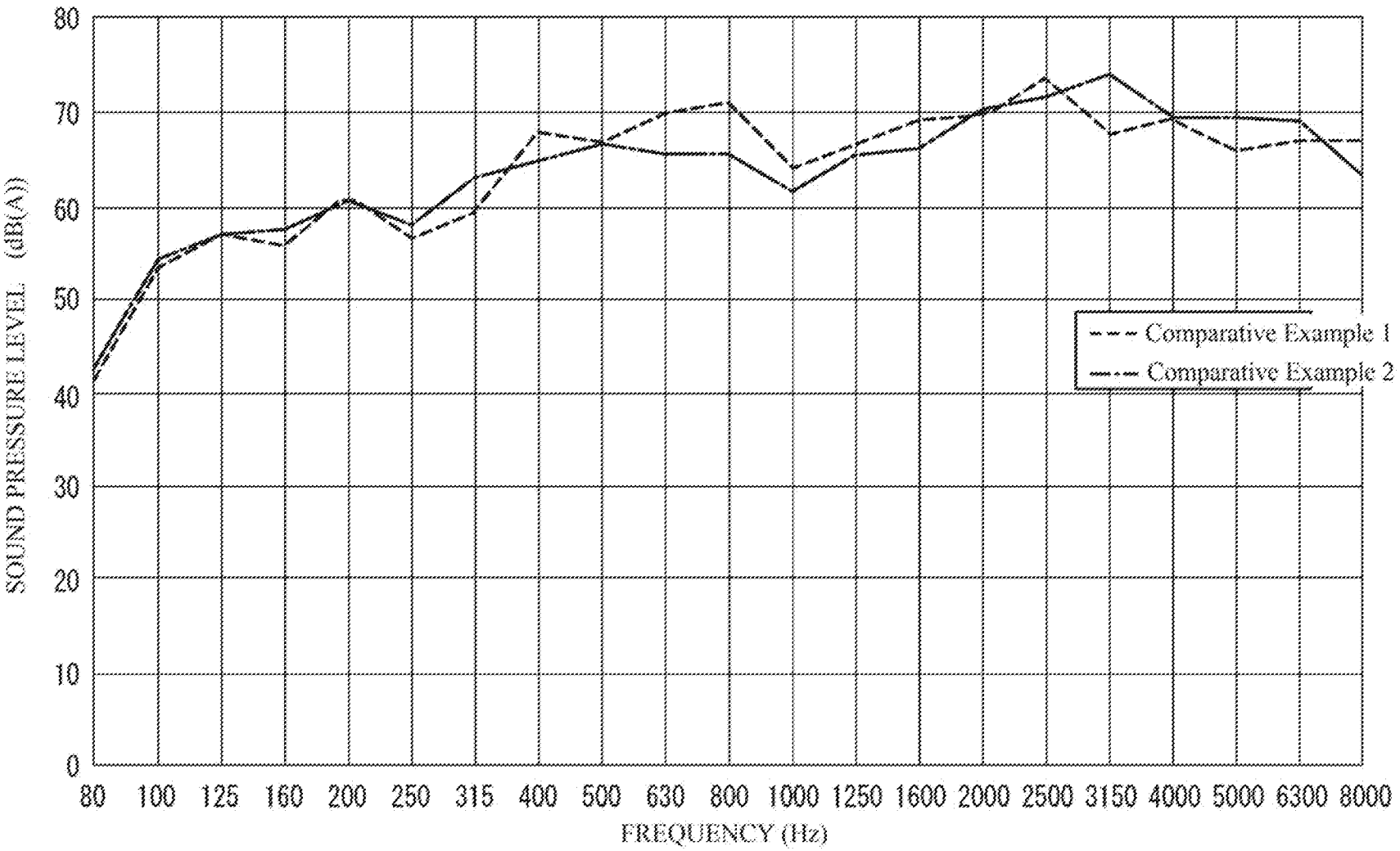
FIG. 3 is a graph showing sound pressure levels of Comparative Examples 1 and 2.
Figure 4:
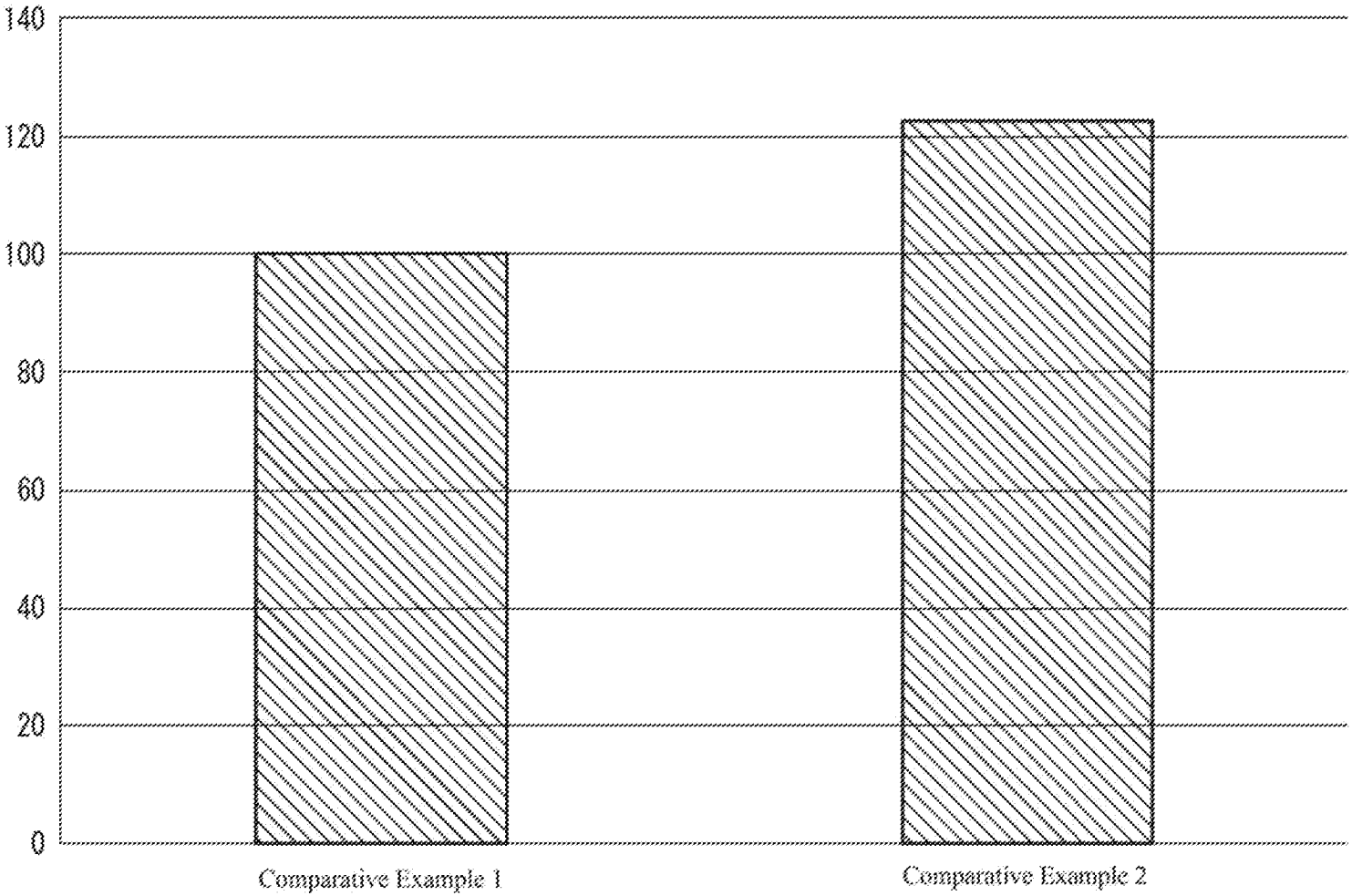
FIG. 4 is a graph showing pressure losses of Comparative Examples 1 and 2.

FIGS. 3 and 4 show noise levels and pressure losses of an intake air duct with a Helmholtz resonator that can deal with frequencies of 800 Hz and 1000 Hz and the intake air duct of Patent Document 2 for comparison.

FIG. 3 is a graph showing the results of noise measurements made in an air intake test. In FIG. 3, an axis of abscissa indicates frequencies [Hz], and an axis of ordinate indicates sound pressure levels [dB (A)]. A broken line indicates a sound pressure level of Comparative Example 1 represented by the intake air duct with the Helmholtz resonator, and an alternate long and short dash line indicates a sound pressure level of Comparative Example 2 represented by the intake air duct of Patent Document 2. FIG. 4 is a graph showing pressure losses. In FIG. 4, a pressure loss of Comparative Example 2 is shown by percentage when a pressure loss of Comparative Example 1 is referred to as 100%.

As FIG. 3 shows, the sound pressure level of Comparative Example 2 is lower than the sound pressure level of Comparative Example 1 in a frequency band of 500 to 2000 Hz. Due to this, it is considered that the structure of Patent Document 2 should be adopted only from the viewpoint of reducing the noise level.

As FIG. 4 shows, however, the pressure loss of Comparative Example 2 is greater by 21% or more than that of Comparative Example 1. The pressure loss of an intake air duct affects directly the air intake efficiency of an engine. Due to this, in the event that the pressure loss of the intake air duct increases, for example, by 20%, although depending upon conditions, it is estimated that the output of the engine is deteriorated by 1.5 PS.

In this way, although the intake air duct proposed by Patent Document 2 can be expected to reduce the noise of the frequency range of 500 to 2000 Hz, the intake air duct has a disadvantage of reducing the output of the engine remarkably. Due to this, the inventor originally thought that the intake air duct of Patent Document 2 could be adopted for the seat air conditioning system whose intake air flow rate is small, but could be hardly adopted for the engine intake air duct whose intake air flow rate is great.

However, as a result of having studied various intake air ducts of other systems, the inventor has found that it is difficult to satisfy simultaneously the three required properties of being quiet, having a low pressure loss, and being small in size.

For example, an intake air duct with a Helmholtz resonator or an intake air duct with a side branch is designed to reduce engine noise by disrupting an air column resonance within the intake air duct by making use of a resonance phenomenon. In some of engine noises, noise generated by a combustion occurring in the engine generates an air column resonance in the intake air duct, which is then emitted from the intake opening of the intake air duct. Then, a noise of a specific frequency can be reduced by mounting a resonator or a side branch tuned to an arbitrary frequency in the intake air duct.

However, the noise reduction using the Helmholtz resonator or the side branch is available only for a limited frequency band. Therefore, to reduce noises in a wide frequency band, a plurality of Helmholtz resonators or side branches need to be provided in the intake air duct, and this enlarges the size of the intake air duct.

In this way, with the intake air duct with the Helmholtz resonator or the intake air duct with the side branch, although the pressure loss remains small, it is difficult to reduce noises in a wide frequency band while remaining small in size.

Then, the inventor has studied again the possibility of adopting the intake air duct of Patent Document 2 for an engine intake air duct. In the structure of the intake air duct of Patent Document 2, an intake portion is attached to a main duct portion at right angles. Thus, the inventor thought that the high pressure loss occurred at the bent portion.

When the intake portion is attached to the main duct portion at right angles, air that flows in along an inner wall of the intake portion is discharged into an interior of the main duct portion. However, part of the air flow is directed towards a reflecting wall and is thereafter reversed to flow towards the intake portion, whereby a vortex is generated. Generating such a vortex generates in turn a pressure loss. Additionally, the vortex generates a wind noise of a frequency band of 2000 to 8000 Hz. This can be verified from Comparative Example 2 in FIG. 3. In addition, when the flow of air drawn enters an extending portion while generating a vortex, it vibrates (resonates) a wall surface of the extending portion to generate another noise. This can be confirmed to occur in a frequency band of somewhere from 250 to 350 Hz in Comparative Example 2 in FIG. 3.

Then, in order to reduce the pressure loss, the inventor has thought of an idea that in the configuration of Patent Document 2, the intake portion is caused to connect to the main duct portion smoothly.

Figure 5:
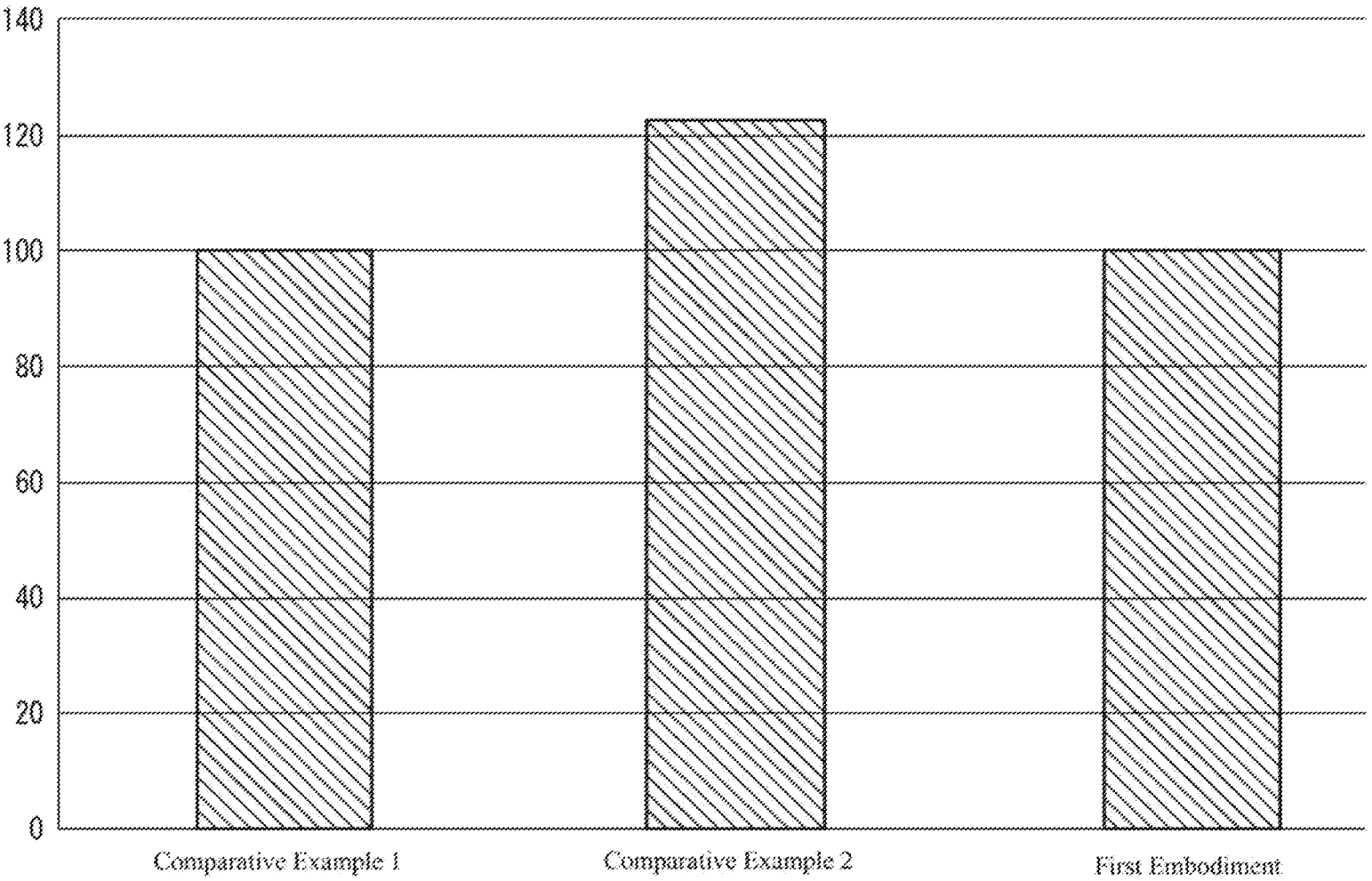
FIG. 5 is a graph showing pressure losses of the first embodiment and Comparative Examples 1 and 2.
Figure 6:
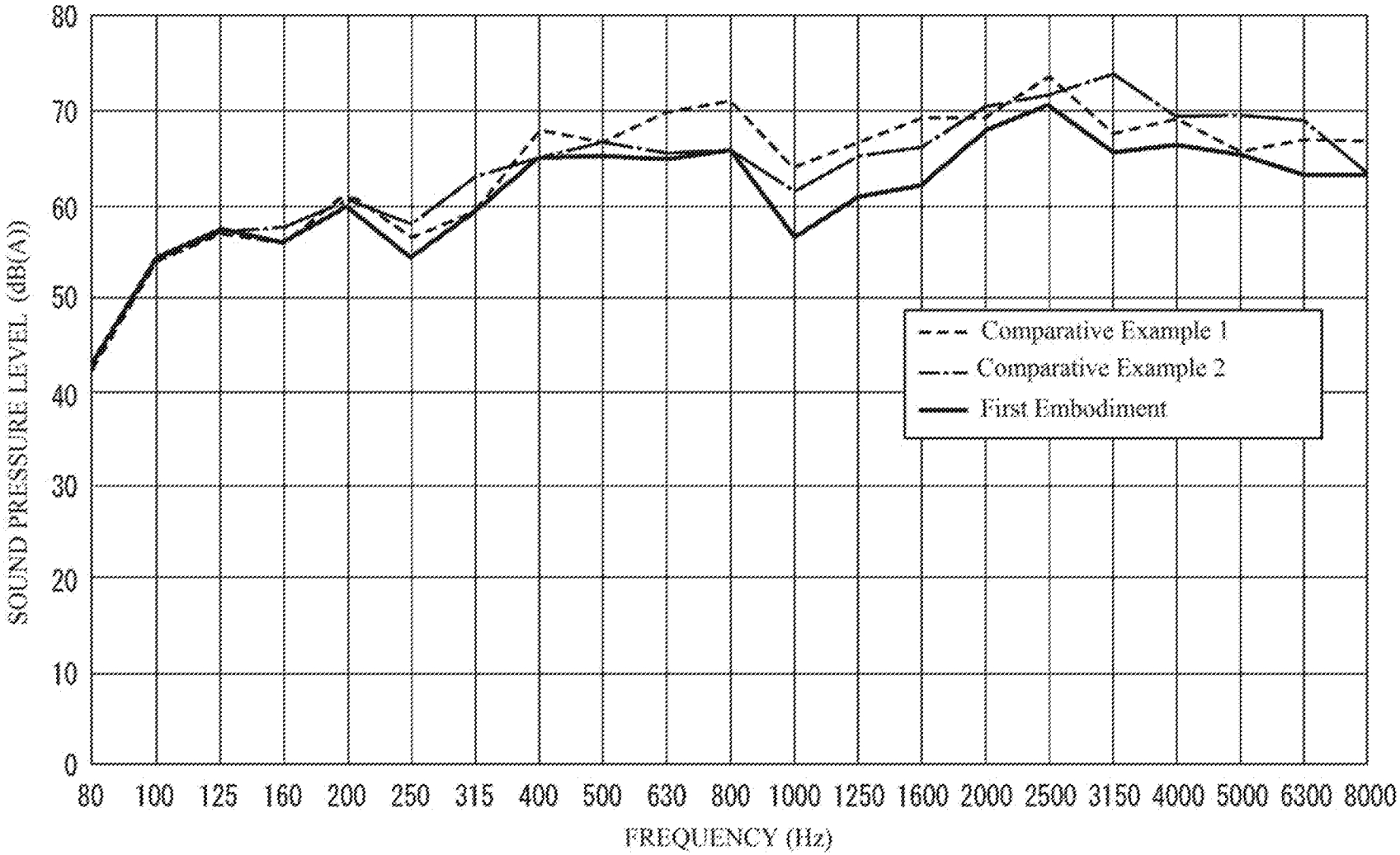
FIG. 6 is a graph showing sound pressure levels of the first embodiment and Comparative Examples 1 and 2.

FIG. 5 is a graph showing pressure losses. In FIG. 5, the pressure loss of Comparative Example 2 and a pressure loss of the first embodiment are shown by percentage when the pressure loss of Comparative Example 1 is referred to as 100%. FIG. 6 is a graph showing the results of noise measurements made in an air intake test. In FIG. 6, an axis of abscissa indicates frequencies [Hz], and an axis of ordinate indicates sound pressure levels [dB (A)]. A broken line indicates a sound pressure level of Comparative Example 1 represented by the intake air duct with the Helmholtz resonator, an alternate long and short dash line indicates a sound pressure level of Comparative Example 2 represented by the intake air duct of Patent Document 2, and a solid line indicates a sound pressure level of the first embodiment.

As FIG. 5 shows, according to the engine intake air duct 1 of the first embodiment, the pressure loss can be reduced by nearly 20%, when compared with Comparative Example 2, and the pressure loss of the first embodiment can be made substantially equal to that of Comparative Example 1. It is considered that by forming the intake portion 10 into the shape so as to connect the intake portion 10 to the main duct portion 20 smoothly, air that flows in along the inner wall of the intake portion 10 is fed into the interior of the main duct portion 20 while maintaining its direction, whereby the air so flowing in is restrained from flowing towards the reflecting wall 41. It is then considered that the resulting air flow makes it difficult for a vortex to be generated to thereby reduce the pressure loss.

Moreover, although the inventor has also not expected this, as FIG. 6 shows, according to the intake air duct 1 of the first embodiment, the inventor has found that the sound pressure level in a wide frequency band of 400 to 8000 Hz including a frequency band of 600 to 2000 Hz can be reduced more with the first embodiment than with Comparative Examples 1 and 2.

The pressure loss correlates with the ease of air flow. As has been described above, forming the intake portion 10 into the shape so as to connect the intake portion 10 to the main duct portion 20 smoothly allows air to flow neatly from the intake opening 11 to the discharge opening 21, thereby making it possible to reduce the pressure loss.

In Patent Document 2 and this embodiment, however, the intake air ducts are designed according to the design concept in which the flow path is formed in such a way that the intake portion 10 connects to the main duct portion 20 at right angles, so that not only a sound from the engine is prevented from propagating to the intake opening 11, but also the sound from the engine reflected by the reflecting wall and another sound from the engine cancel each other out, whereby the noise is reduced. Due to this, in a case where the intake portion 10 is formed into the shape by which the intake portion 10 is allowed to connect to the main duct portion 20 smoothly, part of a sound from the vehicle air cleaner does not flow towards the reflecting wall 41 but flows towards the intake opening 11. Then, it is concerned that the noise suppression effect by the reflected sound from the reflecting wall 41 is reduced. Further, it is also concerned that part of a sound from the vehicle air cleaner flows towards an exterior portion directly from the intake opening 11 to increase the level of vehicle external noise.

Consequently, the inventor expected that the noise reduction effect would be reduced in a case of forming the intake portion 10 into the shape by which the intake portion 10 is allowed to connect to the main duct portion 20 smoothly to reduce the pressure loss. However, although the detailed mechanism is now under research, the result was different from the expectation. As FIG. 6 shows, it can have been confirmed that the first embodiment can reduce the noise of the wide range of frequency of 400 to 8000 Hz more than Comparative Examples 1 and 2.

In this way, the engine intake air duct 1 of this embodiment can solve not only the problem of reducing the pressure loss but also the problem of reducing the noise of the wide frequency band while remaining small in size.

As FIG. 2 shows, a width dimension S1 of the extending portion 40 that intersects the extension (the imaginary line D) of the second center line B in the straight portion 90 at right angles and corresponds to an extending direction of the intake portion 10 from the main duct portion 20 is set greater than a width dimension S2 of the straight portion 90 that intersects the second center line B in the straight portion 90 at right angles and corresponds to the extending direction of the intake portion 10 from the main duct portion 20. Thus, the third center line B" in the extending portion 40 is out of alignment with the second center line B in the straight portion 90 toward the extending direction of the intake portion 10. By configuring the intake air duct 1 in the way described above, it is possible to reduce a risk of engine noise from the vehicle air cleaner leaking from the intake portion 11, thereby making it possible to reduce the noise of the wide frequency band while reducing the pressure loss.

Second Embodiment

Next, another embodiment will be described.

The same reference numerals will be given in the constituent portions that are the same as those of the engine intake air duct 1 according to the first embodiment, and the description of those constituent portions will be omitted.

Figure 7:
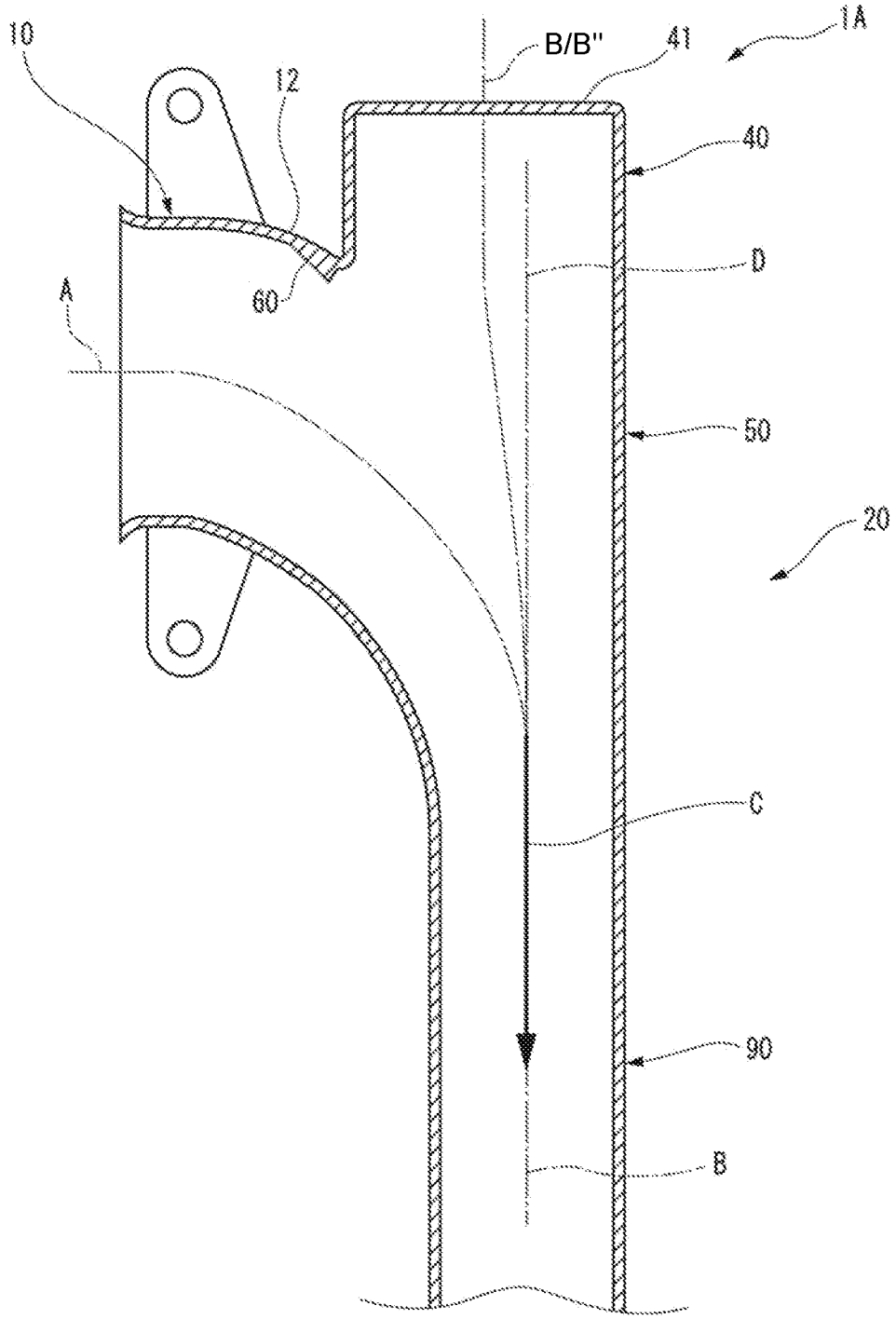
FIG. 7 is a sectional view of an engine intake air duct according to a second embodiment of the invention.

FIG. 7 is a sectional view of an engine intake air duct 1A according to a second embodiment of the invention.

As FIG. 7 shows, the engine intake air duct 1A according to the second embodiment includes a separation promoting projection 60 provided at a merging side end portion of an inner wall of an intake portion 10 where an inner wall of an extending portion 40 merges. The projection 60 projects towards an interior of the intake portion 10. This projection 60 is a triangular prism extending in a direction that intersects a first center line A. A sectional shape of the projection 60 is not limited to a simple triangular shape and hence may be a triangular shape or likes obtained by denting a first side wall 12 inward side of the duct, in which the first side wall 12 is one of side walls making up the intake portion 10 and is merged by a side wall of the extending portion 40.

Figure 8:
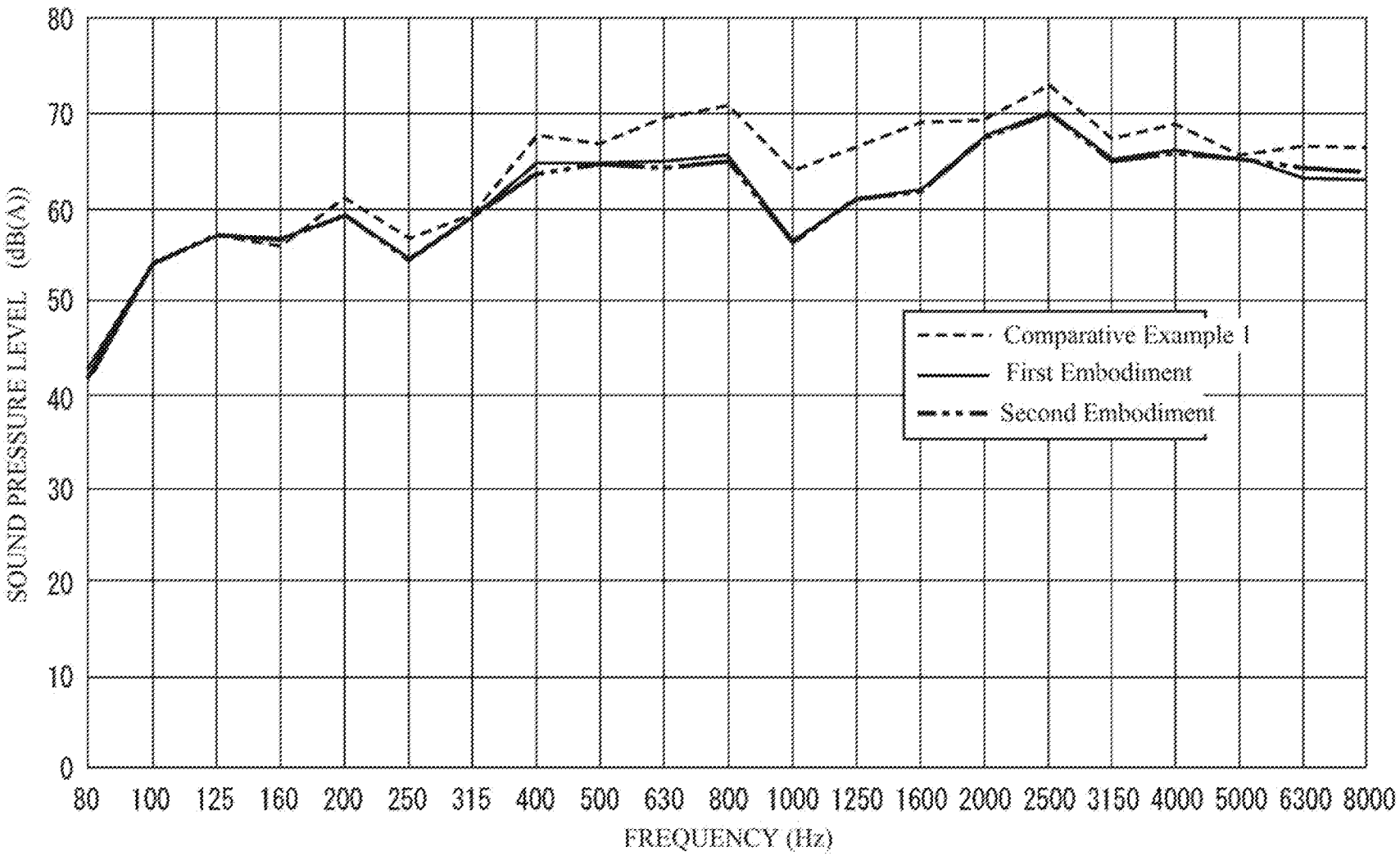
FIG. 8 is a graph showing sound pressure levels of the first embodiment, the second embodiment and Comparative Example 1.

FIG. 8 is a graph showing the results of noise measurements made at the time of an air intake test. In FIG. 8, an axis of abscissa indicates frequencies [Hz], and an axis of ordinate indicates sound pressure levels [dB (A)]. A broken line indicates Comparative Example 1, a solid line indicates the first embodiment, and a chain double-dashed line indicates the second embodiment.

As FIG. 8 shows, a more advantageous sound pressure level is obtained in a frequency band of 400 to 800 Hz by the engine intake air duct 1A according to the second embodiment, than that of the first embodiment.

Figure 9:
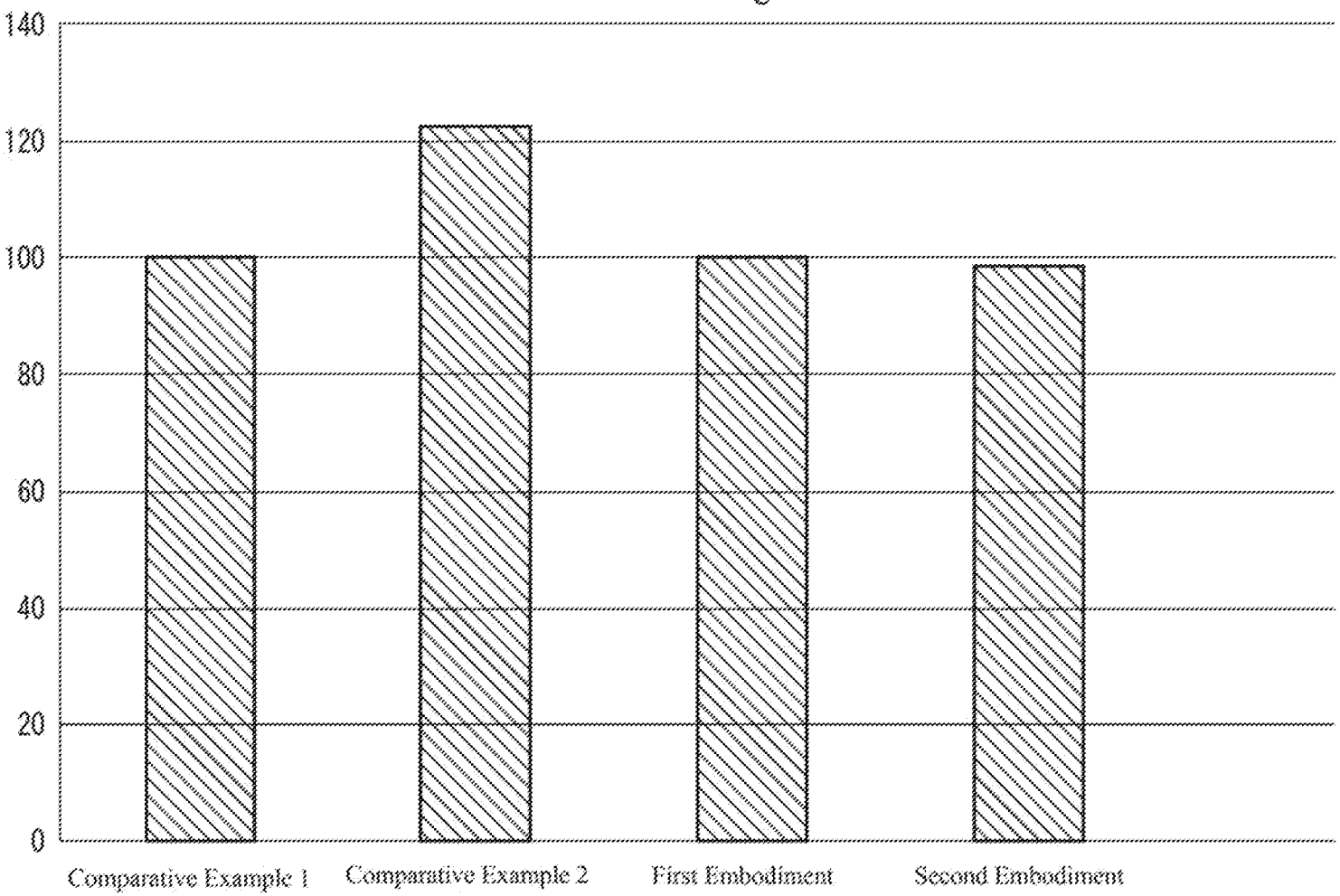
FIG. 9 is a graph showing pressure losses of the first embodiment, the second embodiment and Comparative Examples 1 and 2.

FIG. 9 is a graph showing pressure losses. FIG. 9 shows the pressure loss of Comparative Example 2, the pressure loss of the first embodiment and a pressure loss of the second embodiment that are expressed by percentage when the pressure loss of Comparative Example 1 is referred to as 100%. It was confirmed that the engine intake air duct 1A of the second embodiment provides a lower pressure loss than those of Comparative Example 1 and the first embodiment.

In this way, according to the engine intake air duct 1A of the second embodiment, the pressure loss can be reduced by the projection 60. It is considered that a vortex generated by part of air flowing from the intake portion 10 towards the main duct portion 20 is generated by a phenomenon in which air flowing along the inner wall of the intake portion 10 attempts to flow continuously along the inner wall that continues from the intake portion 10 to the extending portion 40. However, the air flowing along the inner wall is separated from the inner wall by the projection 60 to suppress the phenomenon in which air attempts to flow continuously along the inner wall, whereby the separation of air from the inner wall of the intake portion 10 is promoted to suppress the generation of a vortex. This can not only reduce the pressure loss but also reduce the noise of the wide frequency band.

Third Embodiment

Figure 10:
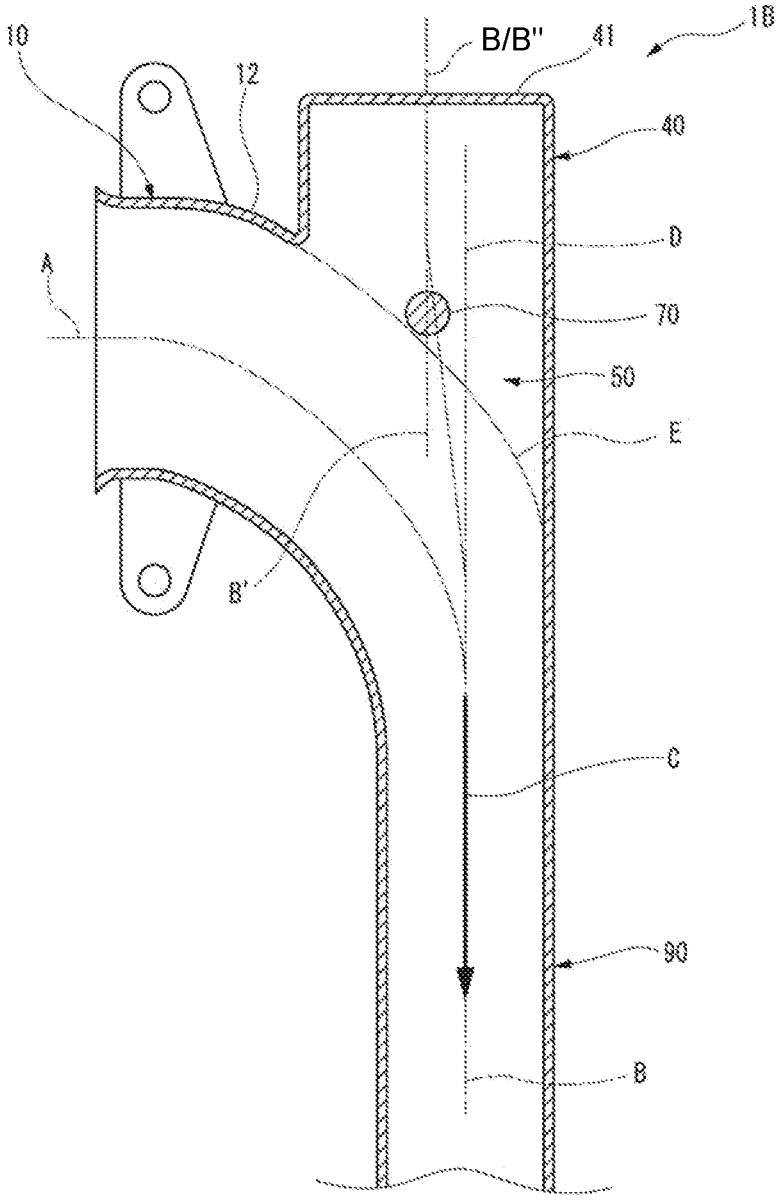
FIG. 10 is a sectional view of an engine intake air duct according to a third embodiment of the invention.

FIG. 10 is a sectional view of an engine intake air duct 1B according to a third embodiment of the invention. As FIG. 10 shows, the engine intake air duct 1B according to the third embodiment has a substantially pillar-shaped reinforcement portion 70. The reinforcement portion 70 extends in a direction that intersects a second center line B to connect between inner walls of a main duct portion 20 that face each other. The reinforcement portion 70 connects between the inner walls having facing wide planes. In this embodiment, the reinforcement portion 70 intersects the second center line B and connects between the inner walls that face each other in a direction that intersects a direction in which an intake portion 10 extends from a main duct portion 20. The reinforcement portion 70 is provided in at least one of a merging portion 50 and an extending portion 40. It is preferable that the reinforcement portion 70 is provided in a position lying nearer to a reflecting wall 41 than a first center line A and its imaginary extension in relation to a duct direction C. Further, it is preferable that the reinforcement portion 70 is provided in a position lying nearer to the reflecting wall 41 than an imaginary extension E of a first side wall 12 that extends towards a straight portion 90 in relation to the duct direction C in a merging portion 50.

It is possible to restrain side walls of the main duct portion 20 from vibrating by providing the reinforcement portion 70, thereby making it possible to restrain the generation of noise attributed to the vibration of the side walls. When an internal pressure of the main duct portion 20 varies, portions of the side walls of the main duct portion 20 that lie near a second center line tend to be displaced largely. Due to this, it is preferable that at least part of the reinforcement portion 70 is provided in a position in the extending portion 40 that passes through the third center line B" or its extension B' to prevent the occurrence of such a displacement.

Fourth Embodiment

Figure 11:
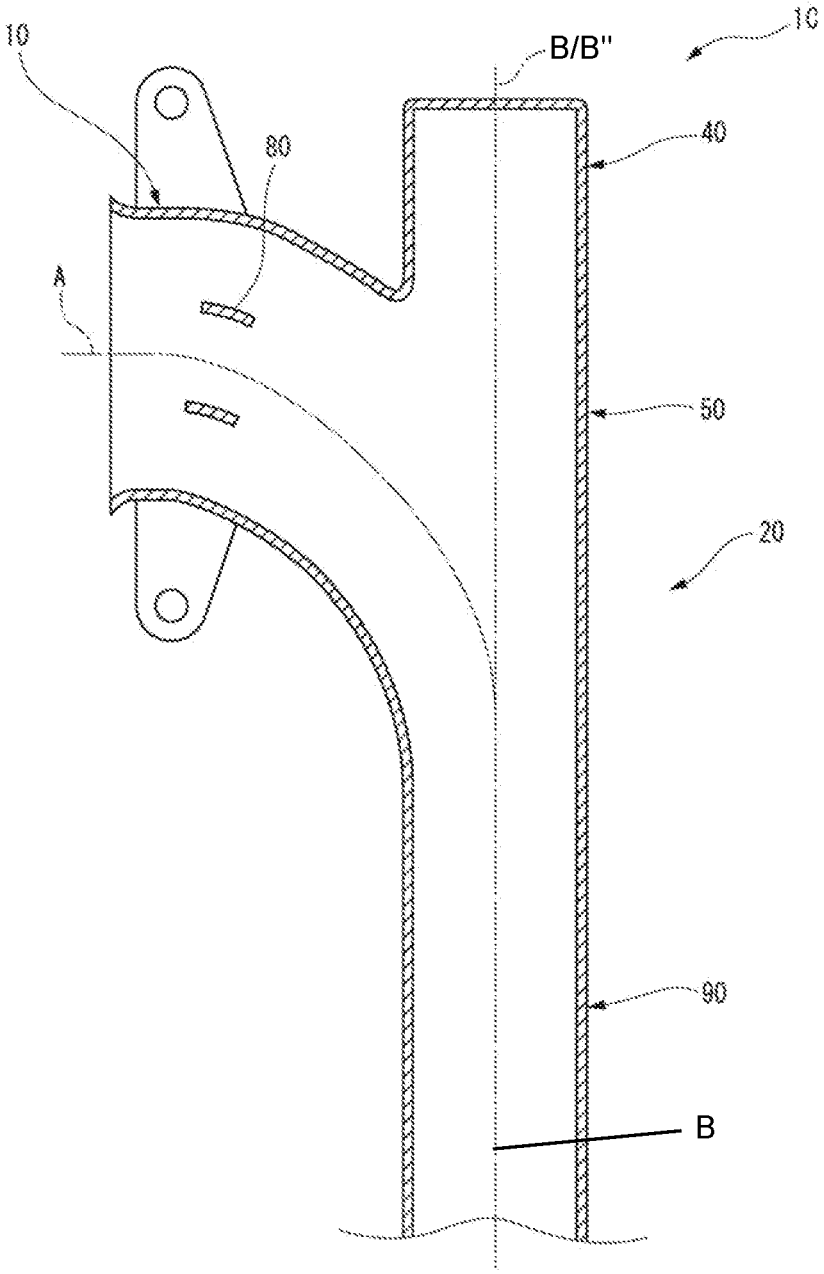
FIG. 11 is a sectional view of an engine intake air duct according to a fourth embodiment of the invention.

FIG. 11 is a sectional view of an engine intake air duct 1C according to a fourth embodiment of the invention. As FIG. 11 shows, the engine intake air duct 1C according to the fourth embodiment has a flow regulating fin 80. A plurality of the flow regulating fins 80 are provided in an intake portion 10 so as to extend along a first center line A and disposed parallel to each other. The flow regulating fins 80 extend in a direction that intersects the first center line A and connect between side walls of the intake portion 10 that face each other. A flow of air inside the intake portion 10 is regulated by the flow regulating fins 80 so as to be guided into a straight portion 90 smoothly. This can restrain air from flowing from the intake portion 10 to an extending portion 40 to thereby reduce a noise of a wide frequency band while reducing a pressure loss.

REFERENCE SIGNS LIST

1A, 1B, 1C: Engine Intake Air Duct; 10: Intake Portion; 11: Intake Opening; 20: Main Duct Portion; 21: Discharge Opening; 30: Exhaust Portion; 40: Extending Portion; 41: Reflecting Wall; 50: Merging Portion; 90: Straight Portion; 60: Projection; 70: Reinforcement Portion; 80: Flow regulating fin; A: First Center Line; B: Second Center Line; C: Duct Direction; S1: Width Dimension; S2 Width Dimension.

What is claimed is:

1. An engine intake air duct configured to be connected to a vehicle air cleaner, the engine intake air duct comprising:

an intake portion having an intake opening configured to draw in air, the intake portion extending along a first center line of the intake portion;

a merging portion provided at the intake portion;

a main duct portion having a discharge opening configured to discharge the air towards the vehicle air cleaner, the main duct portion extending along a second center line of the main duct portion, such that the main duct portion has a straight portion extending from the merging portion along the second center line; and an extending portion provided at the merging portion, the extending portion extending from the merging portion towards a location opposite to the straight portion and along a third center line of the extending portion, wherein a reflecting wall configured to reflect a sound from the vehicle air cleaner is provided at an end face of the extending portion such that the reflecting wall is perpendicular to each of the second center line of the straight portion of the main duct portion and the third center line of the extending portion, wherein the intake portion merges with the main duct portion in such a way that the first center line of the intake portion is directed towards the straight portion of the main duct portion, wherein the intake portion is defined by a curved segment such that with respect to a direction of a flow of the air in the straight portion of the main duct portion, a downstream point within the curved segment and on the first center line of the intake portion is always situated farther from the reflecting wall than an upstream point within the curved segment and on the first center line of the intake portion, wherein a width dimension of an entirety of the extending portion, in an area from the reflecting wall to the merging portion is greater than a width dimension of the straight portion of the main duct portion, and wherein the third center line of the extending portion is out of alignment with the second center line of the straight portion of the main duct portion such that with respect to a direction of a flow of air through the intake opening of the intake portion, the third center line of the extending portion is located closer to the intake opening than the second center line of the straight portion of the main duct portion a portion.

2. The engine intake air duct according to claim 1, wherein a reinforcement portion that extends in a direction intersecting the second center line of the straight portion of the main duct portion and connects inner facing walls of the main duct portion, is provided in at least one of the merging portion and the extending portion.

3. The engine intake air duct according to claim 2, wherein at least part of the reinforcement portion is provided at a position passing through the third center line of the extending portion or at a position adjacent the second center line of the straight portion of the main duct portion.

4. The engine intake air duct according to claim 1, wherein a projection that projects towards an interior of the intake portion, is provided at a merging side end of a side wall of the intake portion.

5. The engine intake air duct according to claim 4, wherein the projection is a triangular prism extending in a direction intersecting the first center line of the intake portion.

6. The engine intake air duct according to claim 1, wherein at least one flow regulating fin that extends along the first center line of the intake portion, is provided in the intake portion.

7. The engine intake air duct according to claim 6, wherein the at least one flow regulating fin connects inner facing walls of the intake portion.

* * * * *